US008261666B2

(12) United States Patent
Garg

(10) Patent No.: US 8,261,666 B2
(45) Date of Patent: Sep. 11, 2012

(54) CHARGING HOLDER FOR A NON-LETHAL PROJECTILE

(76) Inventor: Rakesh Garg, Richardson, TX (US)

( * ) Notice: Subject to any disclaimer, the term of this patent is extended or adjusted under 35 U.S.C. 154(b) by 306 days.

(21) Appl. No.: 12/258,429

(22) Filed: Oct. 26, 2008

(65) Prior Publication Data

US 2010/0101445 A1 Apr. 29, 2010

(51) Int. Cl.
*F42B 12/02* (2006.01)
*F41B 15/00* (2006.01)

(52) U.S. Cl. ..... 102/502; 42/84; 42/1.08; 361/232

(58) Field of Classification Search ..... 102/502, 102/512; 361/232; 42/1.08, 84; 463/47.3; 89/1.11, 1.1
See application file for complete search history.

(56) References Cited

U.S. PATENT DOCUMENTS 6,862,994 B2 * 3/2005 Chang ..... 102/502
6,880,466 B2 * 4/2005 Carman ..... 102/502
7,065,915 B2 * 6/2006 Chang ..... 42/84
7,096,792 B1 * 8/2006 Carman ..... 102/502
7,114,450 B1 * 10/2006 Chang ..... 102/502
7,859,818 B2 * 12/2010 Kroll et al. ..... 361/232
7,950,176 B1 * 5/2011 Nemtyshkin et al. ..... 42/1.08

* cited by examiner

*Primary Examiner* — James Bergin
(74) *Attorney, Agent, or Firm* — Garg Law Firm, PLLC; Rakesh Garg

(57) ABSTRACT

A non-lethal projectile, and a storage and charging mechanism therefor are provided in the illustrative embodiments. An ammunition cartridge includes a propulsion mechanism and a non-lethal projectile. The non-lethal projectile is configured to detach from a launching device when propelled from the launching device, and includes a set of electrodes electrically coupled to an electrical power source. The electrical power source may be a capacitor, a battery, or a combination thereof, and may be rechargeable. The ammunition cartridge may be shaped and sized for firing from a weapon designed to fire a comparably shaped and sized conventional ammunition. A holder for holding and charging a non-lethal projectile in an ammunition cartridge includes a set of conductors to provide a charging current to the electrical power source in the non-lethal projectile. A charging base may receive the holder and provide electrical power to the set of conductors.

8 Claims, 5 Drawing Sheets

CHARGING HOLDER FOR A NON-LETHAL PROJECTILE

BACKGROUND OF THE INVENTION

1. Field of the Invention

The present invention relates generally to a projectile, and in particular, to a projectile for use in a weapon or a launching device. Still more particularly, the present invention relates to a non-lethal projectile for use in conjunction with a lunching device.

2. Description of the Related Art

Traditional weapons, such as handguns, rifles, automatic or semi-automatic fire weapon systems, and other firearms use lethal ammunition. A weapon is a device that can be used for defensive or aggressive application of force, generally deadly force, by launching a projectile from the device towards a target. A target is a person or an object towards which the force is directed.

Ammunition is a combination of a projectile and a mechanism to generate propulsion in a container suitable for use with a weapon. Lethal ammunition is a type of ammunition that when used against a target, such as a person or another living creature, can cause death of the person or the living creature.

For example, conventional ammunition typically used in a handgun or a rifle contains explosive powder in a shell casing that is substantially closed on one end and snug fit with a bullet or a metallic projectile on the other end. When the closed end of the casing is struck, such as with a firing pin or a hammer of a firearm, the explosive power ignites, causing gas pressure to build inside the casing and forcing the bullet at substantial velocity towards a target. The bullet is generally designed to cause physical impact or penetration into the target, thereby delivering deadly force to the target.

A commonly used weapon, such as a semiautomatic or automatic rifle, is capable of holding several units of ammunition in a magazine. The magazine is coupled with the weapon such that when the weapon is fired, the weapon draws one or more units of ammunition from the magazine and fires the projectile of the ammunition to where the weapon is targeted.

Presently used weapons, ammunition, and magazines are capable of delivering deadly force over a significant distance. For example, a nine millimeter bullet, when fired from a common handgun, is capable of travelling more than two miles and still delivering deadly force to a target situated there. Bullets fired from different types of rifles can travel even farther.

Furthermore, presently used weapons, ammunitions, and magazines allow a user portability of the deadly force. A user can carry several units of ammunition in one or more magazines or other containers, such as belts. The user can couple such container with the weapon with speed and ease, and as and when needed, to deliver the deadly force.

Some non-lethal weapons are also presently available. For example, Tazer® weapons deliver electrical shock to a target instead of a projectile (Tazer is a registered trademark of TASER International, Inc., in the United States and other countries). Present non-lethal weapons, such as Tazer guns, launch electrodes from the weapon. Such weapons are designed to carry the electrical power to be delivered from the electrodes. The electrodes are packaged in containers or modules that couple with these specifically designed non-lethal weapons.

For example, a Tazer gun is a specific type of weapon that is generally similar in form-factor and operation as a handgun, but is specifically designed to accept a Tazer module instead of conventional ammunition. The Tazer module is attached to the Tazer gun and launches wires with electrodes at the target-facing end when the trigger of the Tazer gun is operated. There are generally two electrodes, one at a positive potential, and one at a negative or ground potential, that are fired in this manner. The Tazer module is attached to the target-facing end of the body of the Tazer Gun before, during, and after the electrodes are launched.

When the electrodes make physical contact with the target, the Tazer gun delivers high electrical voltage over the wires to the electrodes causing an electrical current to pass through the target. The electrical current temporarily immobilizes the target without killing the target.

As another example, a stun gun is a device that combines an electrical power source, a pair of electrodes, and a switch in a compact portable unit. A user can approach a target, establish physical contact between the electrodes of the unit and the target, and operate the switch. Physical contact between the target and the electrodes of the stun gun device complete an electrical circuit. Operating the switch when the circuit is complete causes electrical current to flow through the target's body. The electrical current, the shock from a high voltage across the electrodes, or a combination thereof, immobilizes the target temporarily.

SUMMARY OF THE INVENTION

The illustrative embodiments provide a non-lethal projectile. An ammunition cartridge according to an illustrative embodiment includes a propulsion mechanism and a non-lethal projectile. The non-lethal projectile is configured to impair a target without a risk of causing permanent harm to the target. The non-lethal projectile is further configured to detach from a launching device when propelled from the launching device. The non-lethal projectile includes a set of electrodes and an electrical power source electrically coupled to the set of electrodes, such that an electrode in the set of electrodes is at a positive potential.

In one embodiment, the non-lethal projectile further may include a first circuit configured to increase the potential difference from a first potential difference available at the electrical power source to a second potential difference available at a pair of electrodes in the set of electrodes.

In another embodiment, the electrical power source may be a capacitor. In another embodiment, the electrical power source may be rechargeable. The non-lethal projectile may further include a second circuit configured to electrically charge the electrical power source.

In another embodiment, the ammunition cartridge may further include a pair of charging leads. The pair of charging leads may be electrically coupled to the electrical power source and may be configured to accept electrical current from a second electrical power source.

In another embodiment, the shape and the size of the ammunition cartridge may be similar to the shape and the size of a particular variety of conventional ammunition. The ammunition cartridge may be capable of being loaded and fired from a weapon designed to fire the conventional ammunition.

In another embodiment, the set of electrodes may be concealed within the non-lethal projectile. Some or all of the electrodes may protrude from the non-lethal projectile and become available to make an electrical circuit using the target when the propulsion mechanism propels the non-lethal projectile.

In another embodiment, a component in the non-lethal projectile may be configured to cause the electrical power source to discharge at a first rate above a threshold rate for a predetermined first period of time. The component may be configured to cause the electrical power source to discharge at a second rate at or below the threshold rate for a second period of time.

In another embodiment, the non-lethal projectile may be propelled from a first ammunition cartridge. The non-lethal projectile may be discharged at the target, reclaimed from the target, recharged, and reused in a second ammunition cartridge.

A holder according to an illustrative embodiment, for holding several ammunition cartridges and charging a non-lethal projectile in an ammunition cartridge from the several ammunition cartridges, includes a set of conductors. The set of conductors is configured to be electrically coupled to an electrical power source, such that when coupled to the electrical power source, the set of conductors provides a charging current to a second electrical power source included in the non-lethal projectile.

In an embodiment, the holder may include a detachable electrical power source. The electrical power source when electrically coupled to the holder may provide electrical power to the conductors of the holder. In another embodiment, a first non-lethal projectile in a first ammunition cartridge in the holder may be different from a second non-lethal projectile in a second ammunition cartridge in the holder.

In another embodiment, the holder may be a magazine. The magazine may be configured to couple with a weapon and supply ammunition cartridges into the weapon for firing.

A charging base according to an illustrative embodiment, for charging a non-lethal projectile, includes an electrically conducting path to an electrical power source. The charging base also includes a first set of contacts corresponding to a second set of contacts in a holder, the holder including an ammunition cartridge, the ammunition cartridge including the non-lethal projectile, such that when the first and second sets of contacts are electrically coupled to each other, the electrical power source provides an electrical current to charge a second electrical power source included in the non-lethal projectile.

In one embodiment, the holder may be a magazine. The magazine may be configured to couple with a weapon and supply ammunition cartridges into the weapon for firing.

In another embodiment, the charging base may be a portable piece of equipment electrically and detachably coupled with the electrical power source. The electrical power source may also be portable.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of illustrative embodiments when read in conjunction with the accompanying drawings, wherein:

DETAILED DESCRIPTION OF THE PREFERRED EMBODIMENT

Figure 1:
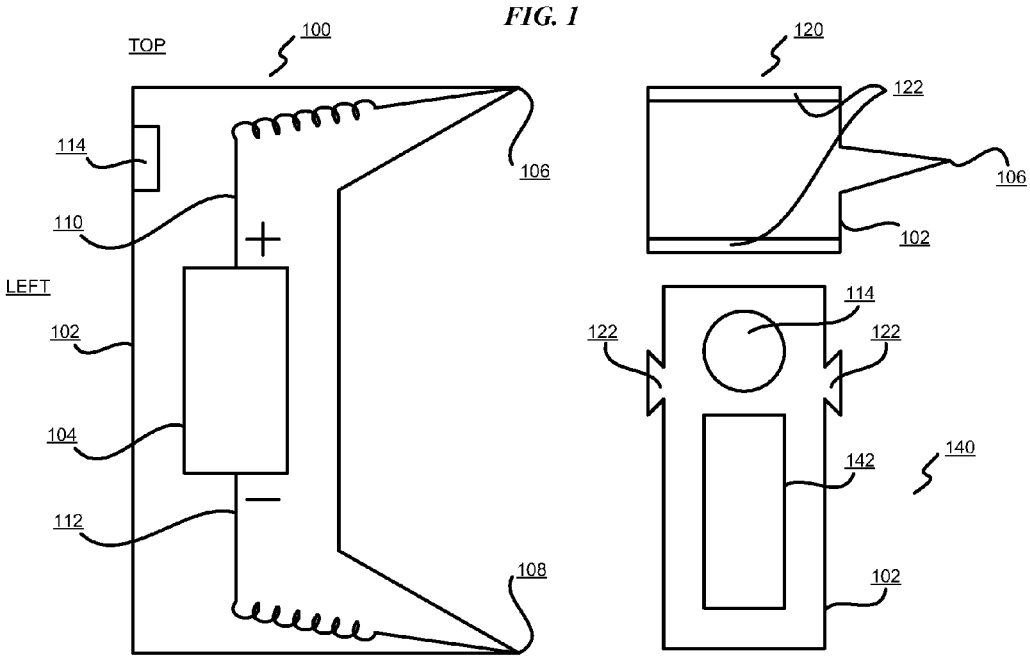
FIG. 1 depicts a block diagram of an example non-lethal projectile in accordance with an illustrative embodiment.

The illustrative embodiments recognize that presently available non-lethal weapons are limited in range over which they can deliver the non-deadly force. For example, a Tazer gun has to be fired from a distance no greater than the length of the wire, generally only a few feet, that is propelled from the Tazer gun. A stun gun has to be placed directly in contact with the target. The illustrative embodiments recognize that the distance between the user of the non-deadly weapon and the target is a factor that affects the safety of the user. The closer the user is to the target, the greater is the chance that the user may lose control of the weapon to the target, or suffer harm from the target.

The illustrative embodiments further recognize that the distance is also a factor in the effectiveness of the weapon. For example, if the presently available non-lethal weapon is farther away from the target than the length of the electrode or the wires connected thereto, the electrodes may not make contact with the target at all and the weapon may be completely ineffective.

To solve these and other problems related to presently available non-lethal weapons, the illustrative embodiments provide a non-lethal projective and a weapon system to deliver the non-lethal projectile. The non-lethal projectile of the illustrative embodiments can be configured for use with any conventional weapon without modifying the weapon.

For example, an embodiment of the non-lethal projectile according to the illustrative embodiments can be fired from a nine millimeter handgun. As another example, another embodiment of the non-lethal projectile according to the illustrative embodiments can be configured to load into a magazine of an assault rifle and fire in the manner of conventional ammunition from the assault rifle. As another example, an illustrative embodiment can be configured to load into a shell casing of any conventional size of ammunition and fired from a corresponding weapon capable of firing that size of the shell casing.

Furthermore, the illustrative embodiments provide a non-lethal projectile that, when fired from a weapon, is not attached to the weapon for the projectile's effectiveness in delivering the non-deadly force. In other words, a user may be able to launch the non-deadly projectile of the illustrative embodiments from a distance and position comparable to the distance and position from which conventional ammunition may be fired. The user of the illustrative embodiments is, therefore, not limited by the length of the electrodes or the wires, as is the case in present non-lethal weapons.

Furthermore, the illustrative embodiments provide a method and system for keeping the non-lethal projectiles effective and ready when needed. For example, an illustrative embodiment may contain an electrical power source combined with the non-lethal projectile. The illustrative embodiments provide ways for keeping the electrical power source charged in various configurations such that the electrical power source may have the power to deliver upon eventual use.

The illustrative embodiments may overcome the above described problems as well as other problems associated with the presently available non-lethal weapons. A particular embodiment may have all, some, or none of the advantages described herein.

The illustrative embodiments are depicted and described using certain familiar shapes and configurations only for clarity of the description. The shapes, the positions, orientations, and interconnections of the various components of the illustrative embodiments may be modified without departing from the scope of the illustrative embodiments. Additionally, the depictions of the placement of the illustrative embodiments relative to a weapon, a mechanism for loading ammunition, a mechanism for carrying ammunition, or a mechanism for storing ammunition, are only used as examples. Many other configurations and placements will be conceivable from this description and the same are contemplated within the scope of the illustrative embodiments.

Furthermore, in some instances, the illustrative embodiments are described using a specific type of weapon only for the clarity of the description. An implementation may use the illustrative embodiments in other weapons, guns, launchers, launching devices, or firearms of other configurations without departing from the scope of the illustrative embodiments.

Furthermore, in some instances, the illustrative embodiments are described using a specific type of propellant only for the clarity of the description. An implementation may use the illustrative embodiments in combination with other types of propellants including explosive powders, chemicals, compression and tension forces, compressed gas cartridges, or any source of mechanical force or fluid pressure, without departing from the scope of the illustrative embodiments.

Specific depictions, descriptions, configurations, or combinations of the illustrative embodiments are only examples and not intended to be limiting on the illustrative embodiments. Many other configurations and combinations of the illustrative embodiments and presently used devices will be apparent from this description and the same are contemplated within the scope of the illustrative embodiments.

With reference to FIG. 1, this figure depicts a block diagram of an example non-lethal projectile in accordance with an illustrative embodiment. Assembly 100 is an example embodiment and includes container 102, electrical power source 104, electrode 106, and electrode 108. View 120 is a top plan view of assembly 100. View 140 is a Left elevation view of assembly 100.

Electrical power source 104 may be electrically coupled to electrodes 106 and 108 using couplings 110 and 112. One of couplings 110 and 112 may provide positive potential to one of electrodes 106 and 108, and the other of couplings 110 and 112 may provide negative or ground potential to the other of electrodes 106 and 108. In FIG. 1, for example, coupling 110 is shown to deliver positive potential to electrode 106 and coupling 112 is shown to deliver negative potential to electrode 108.

Furthermore, coupling 110 or 112 may include one or more conductor, electronic component, or a combination thereof, as may be desirable to condition the electrical power being conducted from electrical power source 104 to electrodes 106 and 108. Conditioning the electrical power, voltage, or current is altering a characteristic of the electrical power, voltage, or current. For example, coupling 110 may include an electrical or electronic circuit to raise the potential available from electrical power source 104 such that electrode 106 may be at a higher potential than the positive terminal of electrical power source 104.

As another example, coupling 110, coupling 112, or both, may include an electrical or electronic circuit that may facilitate electrically charging electrical power source 104. Container 102 may further feature terminals, contacts, or other electrical connection points from where external electrical power may be supplied to electrical power source 104, electrodes 106 and 108, or a combination thereof. Some of these and other features are described in more detail with respect to subsequent figures.

Many additional and optional features may be included in assembly 100. For example, container 102 may be shaped to fit any desired weapon or launching device, such as a presently available Tazer gun, handgun, assault rifle, or a proprietary projectile launching device. In this figure, container 102 is depicted to include area 114 that may be configured to receive the propulsion force. For example, area 114 may be a hardened portion of container 102 to receive mechanical propulsion force, such as force from a compressed spring or piston. As another example, area 114 may be configured to receive the impact of a conventional firing pin of a gun.

View 120 depicts a top view of assembly 100. View 120 shows electrode 106 as may be visible when assembly 100 is viewed from the top. Channels 122 may be additional or optional features of assembly 100. Channels 122 may be designed to facilitate mechanical, electrical, or electromechanical coupling between a weapon and assembly 100. In one embodiment, channels 122 may be projections on one or more sides of assembly 100 such that those projections may mesh with corresponding linear recesses in a weapon or launching device.

Conversely, in another embodiment, channels 122 may be recesses in one or more sides of assembly 100 such that those recesses receive corresponding linear projections in a weapon or launching device. In another embodiment, channels 122 may be a combination of projections, recesses, or indentations.

View 140 depicts a left elevation view of assembly 100. View 140 includes an example depiction of area 114 and channels 122.

Feature 142 may be another additional or optional feature of assembly 100. Feature 142 may be an opening in one embodiment, such as to allow servicing electrical components inside assembly 100. Feature 142 may be a cover to such an opening in another embodiment. In another embodiment, feature 142 may be an area where charging terminals for charging electrical power source 104 may be placed.

Figure 2:
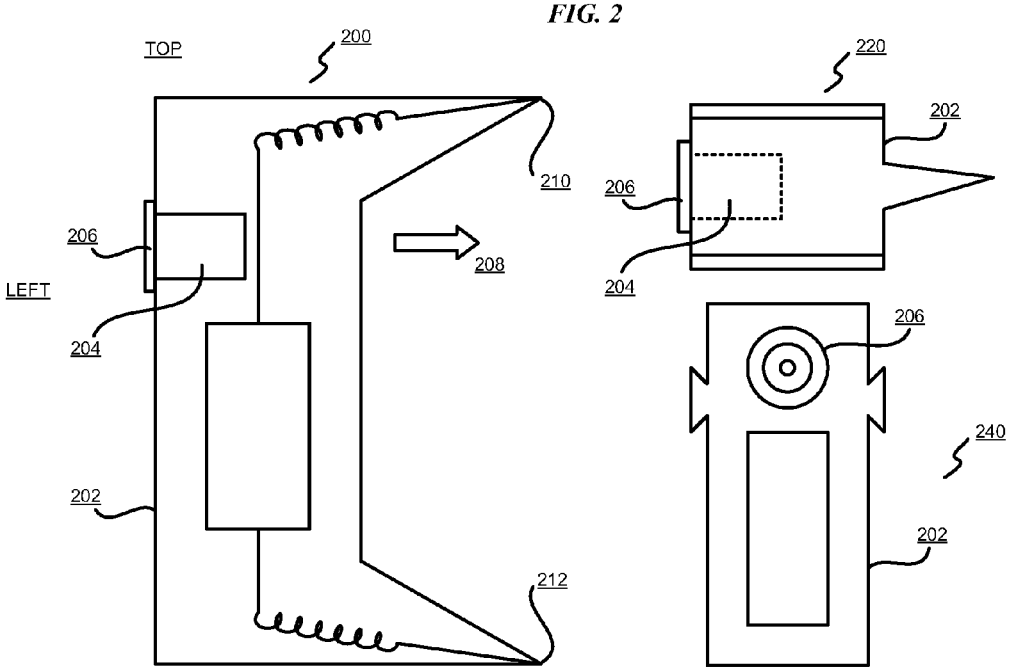
FIG. 2 depicts a block diagram of an example configuration of a non-lethal projectile in accordance with an illustrative embodiment.

With reference to FIG. 2, this figure depicts a block diagram of an example configuration of a non-lethal projectile in accordance with an illustrative embodiment. Assembly 200 and the contents depicted therein are substantially similar to assembly 100 and the contents thereof in FIG. 1. Assembly 200 depicts an alternate example embodiment of assembly 100.

Assembly 200 includes casing 204. Casing 204 may have rim 206. Casing 204 may be similar to the casing of conventional ammunition that stores the explosive powder used for firing the projectile of the conventional ammunition. Rim 206 may be analogous to the closed end of such a conventional cartridge that receives the impact of the firing pin or hammer in conventional weapons. As an example, casing 204 and 206 together may be the casing of a nine millimeter caliber ammunition cartridge.

Casing 204 may be filled with a power propellant similar to the explosive powder propellant used in conventional ammunition. Rim 206 may be struck with a firing pin or hammer. The striking of rim 206 may cause the explosive powder in casing 204 to ignite and generate gas pressure within casing 204. The gas pressure so created may propel container 202 with its contents in direction 208. Direction 208 may lead to a target with which container 202 and its contents may collide.

Upon impact, electrodes 210 and 212 may deliver the electrical energy supplied by the electrical power source in container 202 to the target. Note that container 202, electrodes 210 and 212, the electrical power source, any electronic circuitry contents of container 202, when suitably propelled, can be delivered at any distance from the weapon from which assembly 200 is launched or fired.

View 220 is a top plan view of assembly 200, similar to top plan view 120 in FIG. 1. View 220 depicts a view of an example embodiment of container 202, casing 204, and rim 206 as viewed from the top.

View 240 is a left elevation view of assembly 200. View 240 depicts an example embodiment of rim 206.

Thus, assemblies 100 and 200 are examples of non-lethal projectiles according to some illustrative embodiments. The shapes and relative positions of any components of assemblies 100 and 200 are not limiting on the illustrative embodiments. A particular implementation may shape and position any feature of assemblies 100 and 200 that may be suitable for a particular use. For example, FIGS. 4-7 depict some different shapes and positioning of certain components in other illustrative embodiments.

Figure 3:
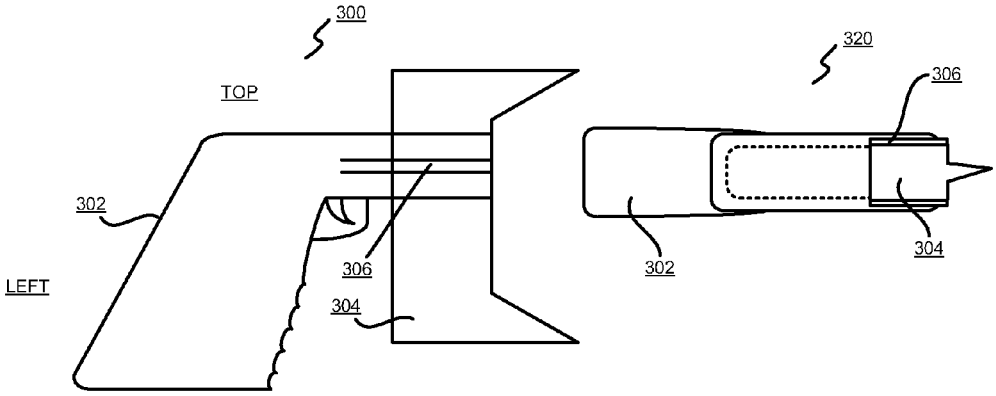
FIG. 3 depicts a block diagram of an example configuration of a launching device and a non-lethal projectile according to an illustrative embodiment.

With reference to FIG. 3, this figure depicts a block diagram of an example configuration of a launching device and a non-lethal projectile according to an illustrative embodiment. View 300 is a front elevation and view 320 is a top plan view of the example configuration.

In view 300, weapon 302 may be a launching device to launch non-lethal projectile 304. Non-lethal projectile 304 may be similar to assembly 100 in FIG. 1 or assembly 200 in FIG. 2. Coupling 306 may be any form of detachable coupling between weapon 302 and non-lethal projectile 304. For example, in one embodiment, coupling 306 may be a combination of channels and recesses in weapon 302 and non-lethal projectile 304. In another embodiment, coupling 306 may be friction coupling. In another embodiment, coupling 306 may be a break-away coupling.

View 320 depicts a top view of weapon 302 coupled to non-lethal projectile 304. View 320 also depicts a top view of coupling 306 in the form of a projections and grooves as an example.

Figure 4:
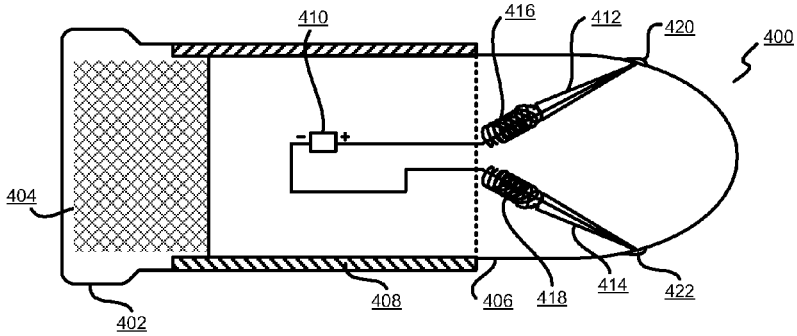
FIG. 4 depicts a block diagram of an example configuration of non-lethal projectile in accordance with an illustrative embodiment.

With reference to FIG. 4, this figure depicts a block diagram of an example configuration of non-lethal projectile in accordance with an illustrative embodiment. Cartridge 400 may be a cartridge that is sized and shaped to be fired from a conventional weapon, such as an M16 assault rifle or its variants, or another firearm.

Cartridge 400 includes casing 402. Casing 402 may contain propellant 404, such as, for example, an explosive mixture, compressed gas, or other suitable propellant. In one embodiment, propellant 404 may be omitted and the propulsion may be generated from an application of a mechanical force externally to casing 402.

Cartridge 400 may further include container 406. Container 406 may be a capsule-like enclosure to house certain aspects of the illustrative embodiments. Insulating material 408 may act as an electrical insulator between casing 402 and container 406. Insulating material 408 may also optionally prevent moisture or temperature variations from affecting propellant 404. Insulating material 408 may be formed using one or more materials as may be suitable for a particular application.

In some implementations, insulating material 408 may be eliminated without departing from the scope of the illustrative embodiments. For example, in one embodiment, insulating material 408 may be eliminated by forming all or part of container 406 from a suitable electrically insulating material, such as a polymer, rubber, or another suitable material.

Container 406 includes electrical power source 410. Electrical power source is electrically coupled to electrodes 412 and 414 such that if an electrically conducting path were created from electrode 412 and 414, an electrical circuit would be formed and an electrical current would flow between electrodes 412 and 414.

In one embodiment, a set of electrodes may be used for this purpose. A set of electrodes is one or more electrodes. For example, one embodiment may use only one electrode coupled to a positive potential terminal of the electrical power source. Firing a single electrode at a positive potential can cause an electrical circuit to be closed by the target if the target is suitably grounded, such as a person standing with wet clothing.

Another embodiment may use a pair of electrodes. In one such embodiment, one electrode may be at a positive potential and the other at a negative or ground potential. In another such embodiment, the two electrodes may provide alternating current. Both electrodes may contact a target and close an electrical circuit.

In another embodiment, several electrodes, some at a positive potential and some at a negative potential may be used. Some of the electrodes at the positive potential and some of the electrodes at the negative potential can be sufficient to close the electrical circuit upon hitting the target.

In one embodiment, electrical power source 410 may be a battery. Some examples of a battery may be a button cell or a commonly used dry-cell alkaline or Lithium ion battery.

Furthermore, electrical power source 410 may be rechargeable. Electrical power may be supplied to electrical power source 410 from a source external to cartridge 400. In another embodiment, electrical power source 410 may be a capacitor, such as a pulse capacitor, capable of discharging at a certain rate when electrodes 412 and 414 close an electrical circuit. For example, electrodes 412 and 414 may make contact with a target's person or clothing and cause an electrical current to flow through the target. The flowing electrical current would cause the capacitor to discharge.

In one embodiment, electrical power source 410 may be capable of discharging rapidly, such as within a predetermined period from the time the electrical circuit is closed. For example, a battery or a capacitor as electrical power source 410 may be configured to discharge within two seconds of the electrical circuit closing. Any period may be chosen for discharging in this manner within the scope of the illustrative embodiments.

In another embodiment, electrical power source 410 may discharge at differing rates over different periods of time. For example, in one embodiment, electrical power source 410 may discharge at a rate above a threshold for one period of time and then discharge at a rate at or below the threshold for another period of time.

For example, electrical power source 410 may be configured, such as through an electronic circuit, to provide sufficient power to disable a target within five seconds. Container 406 may then keep the target impaired for several seconds or minutes by having electrical power source 410 provide continuous or intermittent energy discharge.

Container 406 may further include other electrical or electronic components (not shown). For example, one or more electronic components forming an electronic circuit may be included in the electrical circuit between electrical power source 410 and electrodes 412 and 414.

Cartridge 400 may be installed or loaded into a weapon or a launching device and launched there from. For example, cartridge 400 may be suitably shaped and sized to fire from an assault rifle. When so fired, container 406 may detach from casing 402 and become a projectile traveling towards a target.

Electrodes 412 and 414 may further be configured to protrude from container 406 when or after cartridge 400 is launched. As an example, electrodes 412 and 414 may be coupled with components 416 and 418 respectively. In one embodiment, components 414 and 416 may be compressed springs that may force electrodes 412 and 414 respectively out of one or more opening through container 406. For example, covers 420 and 422 may be detachable or break-away covers on openings in container 406. When components 416 and 418 expand, covers 420 and 422 may detach or break-away from container 406, exposing one or more openings in container 406 for electrodes 412 and 414 to protrude there through.

Figure 5:
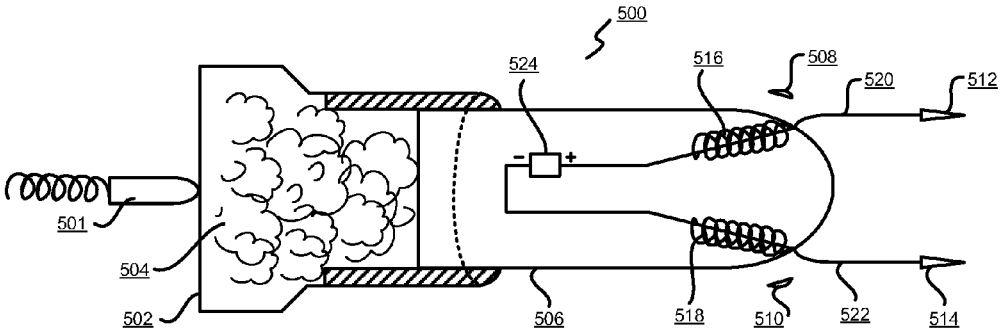
FIG. 5 depicts a block diagram of an example configuration of non-lethal projectile upon firing in accordance with an illustrative embodiment.

With reference to FIG. 5, this figure depicts a block diagram of an example configuration of non-lethal projectile upon firing in accordance with an illustrative embodiment. Cartridge 500 may be analogous to cartridge 400 in FIG. 4.

When a user desires to fire cartridge 500, the user may cause firing mechanism 501, such as a firing pin, a hammer, or another similar mechanism, to contact casing 502. For example, the user may actuate a trigger on a weapon in which cartridge 500 may be loaded to cause firing mechanism 501 to activate.

Firing cartridge 500 in this manner causes gases 504 to exert pressure on container 506. The pressure from gases 504 causes container 506 to detach from casing 502 and propel away from casing 502, such as towards a target.

Further, as container 506 propels in a direction, one or more components, such as components 508 and 510, may detach from container 506. Components 508 and 510 may be implemented using covers 420 and 422 in FIG. 4, and may be detachably coupled to container 506. Alternatively, container 506 may be so configured as to cause one or more portions that form components 508 and 510 of container 506 to break away. Detaching of one or more such components may expose one or more openings in container 506.

Electrodes 512 and 514 may protrude from the one or more openings created when components 508 and 510 detach from container 506. An electrode may itself be one or more electrical terminals. An opening may allow one or more electrodes or electrical terminals to protrude there through.

An electrode may be forced out of such opening in any manner suitable for a particular implementation. For example, in one embodiment, component 516, such as a compressed spring, may impart force to electrode 512 causing electrode 512 to protrude from an opening created by detached component 508. Component 518 may similarly force electrode 514 out of an opening in container 506.

In another embodiment, electrodes may force their way out of container 506 by their own inertia. In another embodiment, a portion of gases 504 may be utilized to cause electrodes 512 and 514 to protrude from container 506. In another embodiment, electrodes 512 and 514 may be coupled to container 506 such that electrodes 512 and 514 are fixedly exposed from container 506. The ways of exposing the electrodes described above are only examples and are not intended to be limiting on the illustrative embodiments. Many other alternative ways of exposing the electrodes upon launching container 506 will be apparent from this disclosure and the same are contemplated within the scope of the illustrative embodiments.

Leads 520 and 522 electrically couple electrodes 512 and 514 to electrical power source 524 in container 506. The length of leads 520 and 522 may be any length suitable for a particular implementation, and need not be equal to one another. For example, in one embodiment, leads 520 and 522 may be so short as to only allow a portion of electrodes 512 and 514 to protrude from container 506 while remaining electrically coupled to electrical power source 524. In another embodiment, leads 520 and 522 may be so long as to allow electrodes 512 and 514 to extract completely from container 506 and be at some distance from container 506 while remaining electrically coupled to electrical power source 524 within container 506 in flight.

Figure 6:
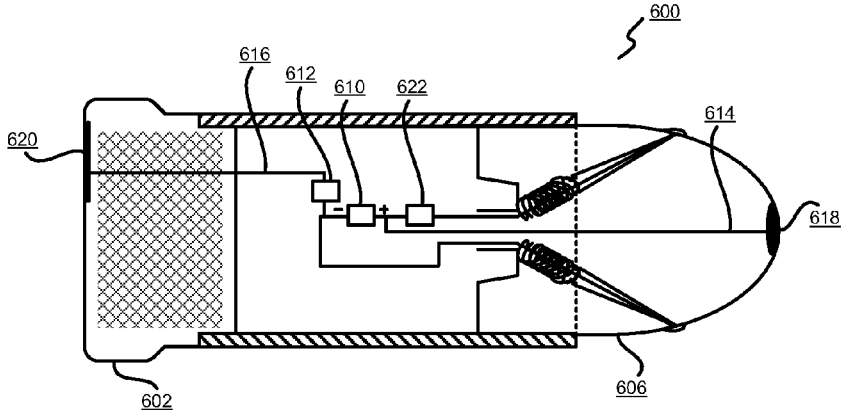
FIG. 6 depicts a block diagram of an example non-lethal projective in another configuration in accordance with an illustrative embodiment.

With reference to FIG. 6, this figure depicts a block diagram of an example non-lethal projectile in another configuration in accordance with an illustrative embodiment. Cartridge 600 may be similar to cartridge 400, casing 602 may be similar to casing 402, and container 606 may be similar to container 406 in FIG. 4. Cartridge 600 may further include certain additional features as described here.

Electrical power source 610 may be similar to electrical power source 410 in FIG. 4. Cartridge 600 may include components that may facilitate recharging electrical power source 610. As an example, charging circuit 612 may be electrically coupled to electrical power source 610. In one embodiment, charging circuit 612 may simply be an electrical conductor coupling electrical power source 610 to an external charging circuit.

In another embodiment, charging circuit may include additional electronic components, such as to rectify an alternating charging current, prevent or condition over current or under current, prevent or condition voltage fluctuations, or process an electrical charging current in other ways.

Furthermore, charging circuit 612 may be coupled in series or parallel configurations to the positive terminal, negative terminal, or both terminals of electrical power source 610 within the scope of the illustrative embodiments. An electrical path between electrical power source 610 and charging circuit 612 may include other electrical or electronic components.

Charging leads 614 and 616 may be electrical conductors. Charging leads 614 and 616 may enable passing a charging current to electrical power source 610. Charging leads 614 and 616 may be coupled to electrical power source 610 directly, indirectly through another circuit or component such as charging circuit 612, or a combination thereof.

Furthermore, charging leads 614 and 616 may be situated, placed, positioned, or oriented in cartridge 600 in any manner suitable for a particular implementation. In one embodiment, as depicted, charging lead 614 may electrically couple one terminal of electrical power source 610 to electrical contact 618. Electrical contact 618 may be any specific electrical contact point anywhere in cartridge 600 or may be container 606 as a whole. Charging lead 616 may electrically couple the other terminal of electrical power source 610 to another electrical contact anywhere in cartridge 600, such as electrical contact point 620 or casing 602 as a whole. In another embodiment, charging leads 614 and 616 may electrically couple to any other suitable part of cartridge 600 for similar purposes. Charging lead 616 may be electrically coupled to a corresponding terminal of an electrical power source external to cartridge 600.

Specific locations of charging leads and electrical contacts are described here only as examples and are not limiting on the illustrative embodiments. Other configurations of the charging leads, electrical contacts, components of cartridge 600 will be apparent from this disclosure. For example, an implementation may couple charging lead 614 to casing 602 and charging lead 616 to container 606 without departing from the scope of the illustrative embodiments.

Cartridge 600 may further include circuit 622. Circuit 622 may, for example, allow regulating the voltage available from a terminal of electrical power source 610 to a higher or lower voltage that can be delivered via any of the electrodes. For example, electrical power source 610 may be able to deliver voltage up to nine volts of potential difference. Circuit 622 may enable increasing the voltage to thousands of volts of potential difference at an electrode of cartridge 600. In this manner, circuit 622 may enable delivering a high voltage low current non-lethal shock to the target when the electrodes of container 606 make contact with the target.

In one embodiment, circuit 622 may increase or decrease the potential difference available at electrical power source 610 to provide to the electrodes. For example, circuit 622 may be configured such that the potential difference of electrical power source 610 is increased to a certain potential difference. The increase may persist for a configured period of time. For example, for a first shock, twelve volts may be increased to thirty five thousand volts for one second.

Circuit 622 may be further configured to change the potential difference of electrical power source 610 to another certain potential difference. For example, for a second shock, twelve volts may be increased to fifteen thousand volts for one second after fifteen seconds have elapsed from the first shock.

Specific voltage, potential differences, and time periods described in the above examples are for illustration only and not limiting on the illustrative embodiments. Of course, circuit 622 can be configured to regulate and present any desired potential difference at the electrodes for any duration and after any interval of elapsed time.

Furthermore, within the scope of the illustrative embodiments, circuit 622 may be configured to regulate the current flowing across the electrodes, such as to ensure that the current is less than the current known to create the risk of certain harm to a particular type of target. In some embodiments, circuit 622 may be omitted if electrical power source 610 is capable of delivering the potential difference, current, or both, that may be desired at the electrodes.

The functions of circuits 612 and 622, and electrical power source 610 described here are only example functions selected for the clarity of the description. Many other functions of circuits 612 and 622, and electrical power source 610 may be included in a particular implementation of these components without departing from the scope of the illustrative embodiments. For example, an implementation of circuit 622 may include a timer, such as for timing the increase or decrease of potential difference or current across the electrodes. Such additional functions are contemplated within the scope of the illustrative embodiments.

The relative locations of charging circuit 612, circuit 622, and electrical power source 610 with respect to one another in an electrical circuit is described only as an example. Many other configurations by repositioning, combining, or further dividing these electrical and electronic components, and by adding or removing certain electrical and electronic components will be apparent from this disclosure. For example, an implementation may couple charging circuit 612 to the positive terminal of electrical power source 610, or to both terminals of electrical power source 610, without departing from the scope of the illustrative embodiments.

Figure 7:
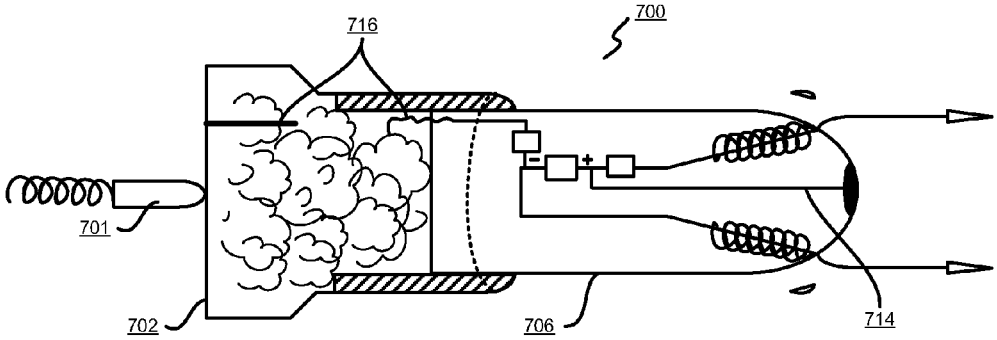
FIG. 7 depicts another block diagram of a non-lethal projectile upon firing in accordance with an illustrative embodiment.

With reference to FIG. 7, this figure depicts another block diagram of a non-lethal projectile upon firing in accordance with an illustrative embodiment. Cartridge 700 may be analogous to cartridge 600 in FIG. 6.

When a user fires cartridge 700, such as by activating firing mechanism 701, container 706 propels in a direction away from casing 702 and towards a target. Contents of container 706 propel towards the target as well.

Charging leads 714 and 716 are analogous to charging leads 614 and 616 in FIG. 6. As container 706 propels away from casing 702, charging lead 716 may break or detach, freeing container 706 and its contents to propel away from casing 702. In one embodiment, charging lead 716 may be configured with a breaking point at which the break may occur upon firing cartridge 700. In another embodiment, a connector in charging lead 714, 716, or both, may allow attachment, detachment, and reattachment of casing 702 and container 706. In one embodiment, both charging leads 714 and 716 may detach from their respective connection points.

Figure 8:
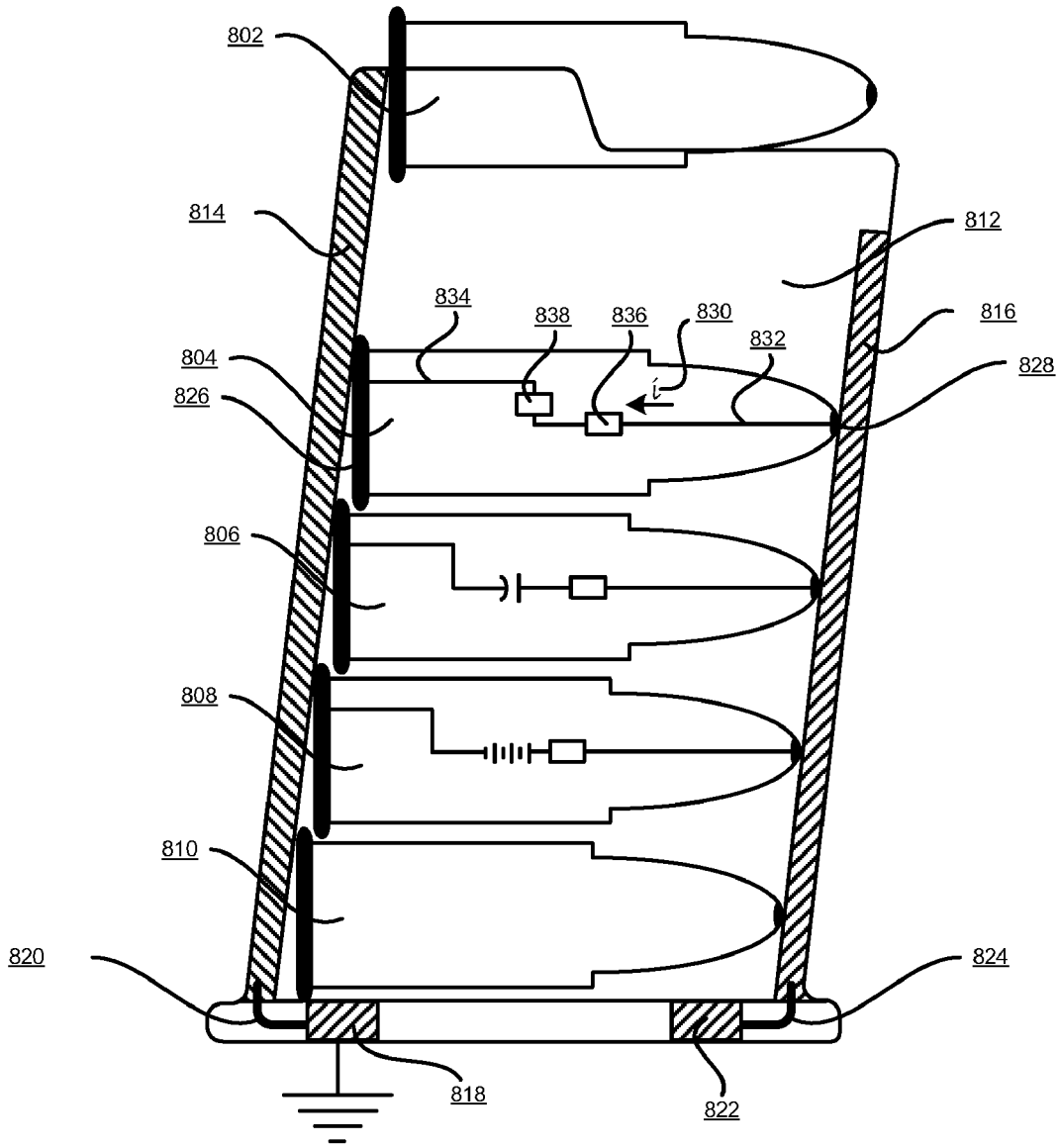
FIG. 8 depicts a block diagram of an example loading mechanism for holding and charging the non-lethal projectiles in accordance with an illustrative embodiment.

With reference to FIG. 8, this figure depicts a block diagram of an example loading mechanism for holding and charging the non-lethal projectiles in accordance with an illustrative embodiment. Cartridges 802, 804, 806, 808, and 810 may each be a cartridge analogous to cartridge 400 in FIG. 4 or 600 in FIG. 6.

Magazine 812 may be similar to a magazine device used for loading several units of ammunition into a weapon. Furthermore, magazine 812 is illustrated as a commonly known magazine device for loading several units of conventional ammunition only as an example. The principles of magazine 812 may be used in conjunction with any container, holder, organizer, or loader of ammunition units without departing the scope of the illustrative embodiments. Magazine 812 may include additional features as described here.

Magazine 812 according to an illustrative embodiment may include a set of conductors that may electrically couple cartridges within magazine 812 to an electrical charging mechanism. A set of conductors is one or more conductors. For example, conductors 814 and 816 may each be an electrically conductor of any suitable shape, such as one or more plate or strip.

Magazine 812 may further include contact 818, which may be electrically coupled to conductor 814, such as by using connector 820. Similarly, magazine 812 may include contact 822, which, as an example, may be electrically coupled to conductor 816 using connector 824. An electrical power source may be electrically coupled to contacts 818 and 822. Only as an example, contact 818 is shown coupled to electrical ground. Contact 822 may be, for example, electrically coupled to a positive potential terminal, to provide electrical power to magazine 812.

In one embodiment, conductors 820 and 824 may be omitted. In another embodiment, another arrangement of electrically conducting components may be used such that conductors 814 and 816 receive electrical power as described here.

Cartridge 804 is used here as an example to describe the operation of magazine 812. When cartridge 804 is loaded in magazine 812, conductors 814 and 816 make electrical contact with contacts 826 and 828 of cartridge 804. Contacts 826 and 828 may be similar to electrical contacts 618 and 620 respectively in FIG. 6.

Charging current 830 labeled "i" may flow through charging leads 832 and 834. Charging current 830 may be conditioned by charging circuit 836, and may charge electrical power source 838.

Operating as in the above described example configuration, magazine 812 may be loaded with one or more cartridges, such as cartridge 804. Magazine 812 may then be coupled to an electrical power source, such as by placing magazine 812 in electrical contact with a compatible charging base. The charging base may provide electrical charging current 830 to the one or more cartridges via conductors 814 and 816.

The shapes, positioning, orientation, connections, and electrical polarity of components of FIG. 8 are depicted and described only as examples and are not limiting on the illustrative embodiments. Many other shapes, positions, orientations, and connections may be conceivable from this description for specific implementations. For example, in one embodiment, a conductor in the magazine may be coupled to the electrical ground and shaped to make initial contact with a cartridge when the cartridge is being loaded in the magazine. Configured in this manner, the cartridge may be grounded at loading, and a user loading the cartridges in the magazine may avoid suffering an electrical shock. As another example, another embodiment may include only one conductor that can be coupled to a positive potential, the body of the magazine serving as the electrical ground, or negative conductor.

Furthermore, electrical polarity may be assigned to the various electrical components in a manner different from the polarity depicted in FIG. 8 without departing from the scope of the illustrative embodiments. For example, an implementation may couple conductor 816 to electrical ground instead of conductor 814 as depicted in this figure within the scope of the illustrative embodiments. As another example, an implementation may use alternating current in conductors 814 and 816 instead of direct current as depicted in this figure within the scope of the illustrative embodiments.

Additionally, an implementation may include and couple an electrical power source, such as a battery pack, to conductors 814 and 816. For example, a battery pack may be designed to be detachably coupled to magazine 812 so as to make electrical contact with contacts 818 and 822. Such a battery pack may provide portable charging of non-lethal projectiles in the cartridges in the magazine in locations where an electrical outlet may not be available.

As an example, a soldier's belt or another piece of equipment may provide electrical terminals for receiving electrical power at one set of terminals and accepting a magazine according to the illustrative embodiments at another set of terminals, thereby allowing the soldier to remain mobile and the cartridges in the soldier's magazines to remain charged.

Further, the magazine according to the illustrative embodiments may be loaded with ammunition cartridges that may include different types of non-lethal projectiles. For example, the same magazine may hold and charge non-lethal projectiles that deliver different combinations of voltage and current to the target. As another example, the same magazine may hold and charge non-lethal projectiles that include different types of electrical power sources. For example, one non-lethal projectile may include a capacitor or a capacitor bank as a source of electrical power, whereas another non-lethal projectile may include a battery or a battery pack as a source of electrical power. Many other variations of non-lethal projectile according to the illustrative embodiments are conceivable within the scope of the illustrative embodiments. Any variation can be used with the magazine of the illustrative embodiments within the scope of the illustrative embodiments.

Figure 9:
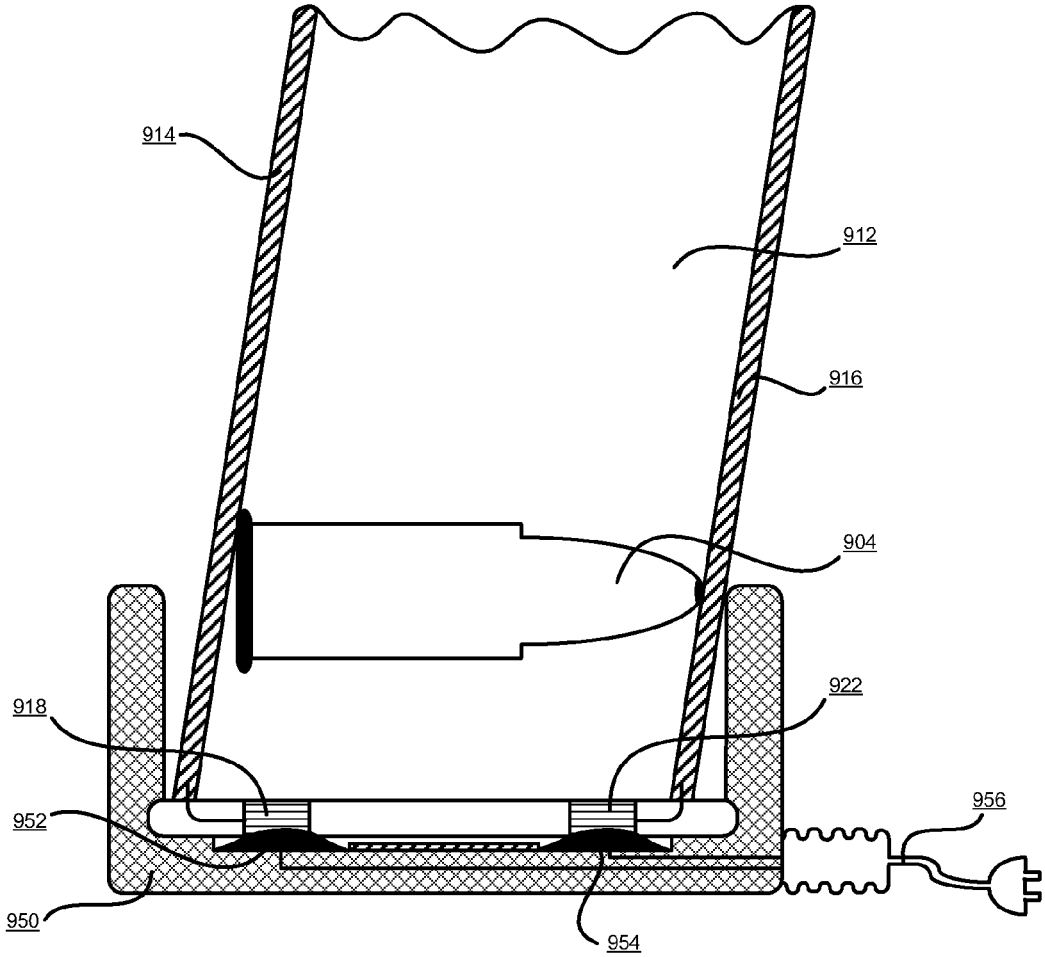
FIG. 9 depicts a block diagram of an example charging base in accordance with an illustrative embodiment.

With reference to FIG. 9, this figure depicts a block diagram of an example charging base in accordance with an illustrative embodiment. Cartridge 904 may be analogous to cartridge 804 in FIG. 8. Magazine 912 may be analogous to magazine 812 in FIG. 8. Conductors 914 and 916 may be analogous to conductors 814 and 816 respectively in FIG. 8. Contacts 918 and 922 may be analogous to contacts 818 and 822 respectively in FIG. 8.

Charging base 950 may be a receptacle compatible with magazine 912. Charging base 950 may receive magazine 912 in a manner that contacts 918 and 922 of magazine 912 make electrical contact with contacts 952 and 954 respectively of charging base 950. Charging base 950 may further include conducting path 956 that may be used to electrically couple charging base 950 to an electrical power outlet.

In one embodiment, contacts 918, 922, 952, and 954 may not be electrically conducting contacts in physical contact with each other. Contact 918, contact 922, or both, in magazine may be electro-magnetically coupled with their corresponding counterpart contact 952, contact 954, or both, in the charging base. Current may be generated between contacts 918 and 922 in the magazine due to the electromagnetic coupling with contacts 952 and 954. Such current may be used to supply charging current to the cartridges loaded in magazine 912.

Additionally, an implementation may include and couple any electrical power source, such as a battery pack, with charging base 950. Such a battery pack may provide portable charging of non-lethal projectiles in the cartridges in the magazine in locations where an electrical outlet may not be available.

The shape, position, orientation, and electrical and electromagnetic characteristics of the components of FIG. 9 are described only as examples and are not limiting on the illustrative embodiments. Many other shape, position, orientation, and characteristics of these components will be apparent from this disclosure and the same are contemplated within the scope of the illustrative embodiments. For example, in one embodiment, charging base may be formed in or using another piece of equipment, such as a user's garment or backpack.

The description of the present invention has been presented for purposes of illustration and description, and may be not intended to be exhaustive or limited to the invention in the form disclosed. Many modifications and variations will be apparent to those of ordinary skill in the art. The illustrative embodiments were chosen and described in order to clearly explain the principles of the invention and the practical application, and to enable others of ordinary skill in the art to understand the invention for various embodiments with various modifications as are suited to the particular use contemplated. For example, while certain illustrative embodiments depict the electrical power source within the non-lethal projectile to be a direct current source, an implementation may substitute the electrical power source and certain other components in the non-lethal projectile to operate using alternating current.

The illustrative embodiments provide a non-lethal projectile that can be adapted for launching from any conventional ammunition firing weapon. The non-lethal projectile of the illustrative embodiments can be used to immobilize a live target or to electrically or electromagnetically interfere with the operation of a system or equipment. For example, a projectile according to the illustrative embodiments can be launched at certain equipment. The projectile may deliver a shock to the equipment to disable some of the functions of the equipment.

An illustrative embodiment or a component thereof can be practiced using any suitable material, and can be formed in any suitable shape and size. A non-lethal projectile according to the illustrative embodiments is detached from the weapon from which it is fired, allowing the non-lethal projectile to travel a distance comparable to the travel of a bullet of traditional ammunition.

Thus, a non-lethal projectile according to the illustrative embodiments may be useful in combat, law enforcement, or other applications where it may be preferable to disable a target without killing or permanently damaging the target. Further, a non-lethal projectile according to the illustrative embodiments may allow disabling the target in this manner from a larger distance as compared to the present non-lethal weaponry.

Additionally, a non-lethal projectile according to the illustrative embodiments may not require special launching devices to be carried on the person of the user. A user may be able to use the same weapon or launching device to fire regular ammunition and a non-lethal projectile according to the illustrative embodiments interchangeably.

Furthermore, the non-lethal projectile of the illustrative embodiments may be launched, recovered, and reused for numerous firings. The non-lethal projectile of the illustrative embodiments may include a rechargeable electrical power source further facilitating the reuse. The rechargeable power source of the non-lethal projectile of the illustrative embodiments may also extend the useful life of the non-lethal projectile of the illustrative embodiments as compared to life of a non-rechargeable non-lethal projectile that may have to be discarded upon a single use or upon decay of its charge over time.

The non-lethal projectile of the illustrative embodiments may be fired using traditional propellants used for conventional ammunition, harpoon type propulsion, compressed gas or fluid canister, or mechanical compression or tension force. Thus, a non-lethal projectile according to the illustrative embodiments may be adaptable for use and deployment in a wide variety of existing weapon systems.

Additionally, the non-lethal projectile according to the illustrative embodiments may be fired from a single shot weapon, a semi-automatic weapon, or a fully automatic weapon. The non-lethal projectiles according to the illustrative embodiments may be carried in magazines, boxes, and belts that may be used for feeding a variety of existing weapons and launching devices.

The magazine, carrying apparatus, loading apparatus, charging apparatus, and recharging apparatus of the illustrative embodiments further enhance the usability of the illustrative embodiments. For example, a soldier may carry and use a magazine according to the illustrative embodiments, carrying non-lethal projectiles according to the illustrative embodiments, in a manner similar to the soldier's present practice. The soldier may load the non-lethal projectile of the illustrative embodiments, into the magazine of the illustrative embodiments, in a manner similar to the soldier's present practice. The soldier may charge the non-lethal projectiles of the illustrative embodiments in a manner commonly used to charge common electronic devices, such as, by using a charging base according to the illustrative embodiments.

Additionally, the user can perform the charging using a commonly available electric outlet. The charging base according to the illustrative embodiments can be modified to electrically couple to any other electric outlet or power source fashioned for specific use, such as defense applications, or foreign power systems.

The features and advantages described above have been selected to describe the utility of the illustrative embodiments only as examples and are not limiting on the illustrative embodiments. Many other uses, features, adaptations, configurations, and applications of the illustrative embodiments will be apparent from this disclosure.

What is claimed is:

1. A holder for holding a plurality of ammunition cartridges, the holder comprising:

a set of conductors configured to be electrically coupled to an electrical power source such that when coupled to the electrical power source, the set of conductors provides a charging current to a second electrical power source included in a non-lethal projectile in an ammunition cartridge in the plurality of ammunition cartridges, wherein the holder is a magazine usable to hold either of a conventional ammunition and the ammunition cartridge including the non-lethal projectile, wherein the ammunition cartridge including the non-lethal projectile is capable of being launched in the manner of the conventional ammunition from a weapon designed to fire the conventional ammunition; and a piece of equipment facilitating the set of conductors to be electrically coupled to the electrical power source, the electrical power source being external to the holder, wherein the piece of equipment includes a first set of electrical terminals for receiving electrical power from the electrical power source and a second set of electrical terminals for accepting the magazine.

2. The holder of claim 1, wherein the piece of equipment is an equipment wearable by a person such that the equipment provides portable charging to the ammunition cartridge while the person wearing the equipment is mobile.

3. The holder of claim 2, wherein the piece of equipment is a belt configured to hold the magazine.

4. The holder of claim 1, wherein the piece of equipment is a charging base configured to receive the magazine.

5. The holder of claim 1, wherein a body of the holder serves as one conductor in the set of conductors.

6. The holder of claim 1, wherein the piece of equipment facilitates the set of conductors to be electrically coupled to the electrical power source using an electro-magnetic coupling.

7. The holder of claim 6, wherein the electro-magnetic coupling is formed between the set of conductors and the second set of terminals.

8. The holder of claim 1, wherein the second electrical power source included in the non-lethal projectile is a rechargeable electrical power source.

* * * * *